United States Patent [19]

Teske

[11] 4,432,412

[45] Feb. 21, 1984

[54] COOLING DEVICE

[76] Inventor: Lothar Teske, Hegelstr. 15, 5000 Koln 90, Fed. Rep. of Germany

[21] Appl. No.: 293,500

[22] Filed: Aug. 17, 1981

[30] Foreign Application Priority Data

Aug. 23, 1980 [DE] Fed. Rep. of Germany ..... 3031851

[51] Int. Cl.[3] ..... F28F 13/12

[52] U.S. Cl. ..... 165/93; 432/131; 432/139; 165/109 T; 366/326; 366/144

[58] Field of Search ..... 165/93-94, 165/120, 121, 88, 109; 432/131, 139; 209/358, 359; 366/326, 144

[56] References Cited

U.S. PATENT DOCUMENTS

| | | | |
|---|---|---|---|
| 2,592,481 | 4/1952 | Spencer et al. | 366/326 X |
| 2,826,126 | 3/1958 | Cowles | 209/389 |
| 3,145,980 | 8/1964 | Smith, Jr. | 165/93 X |
| 3,650,319 | 3/1972 | Boon | 165/93 X |

*Primary Examiner*—William R. Cline
*Assistant Examiner*—Theophil W. Streule

[57] ABSTRACT

Cooling device for coal dust comprising a housing, a motor-driven conveyor system therein to transport the coal dust over coolable trays in the housing and conveyor-wheel arms of spiral curvature for moving the coal dust from one or more inlets to one or more outlets via a series of communicating passages in the trays over which the conveyor-wheel arms pass under actuation of a hydraulic motor mounted above the housing and driving a vertical shaft, to which the conveyor-wheel arms are attached, extending centrally downwardly through the housing.

3 Claims, 3 Drawing Figures

COOLING DEVICE

Figure 1:
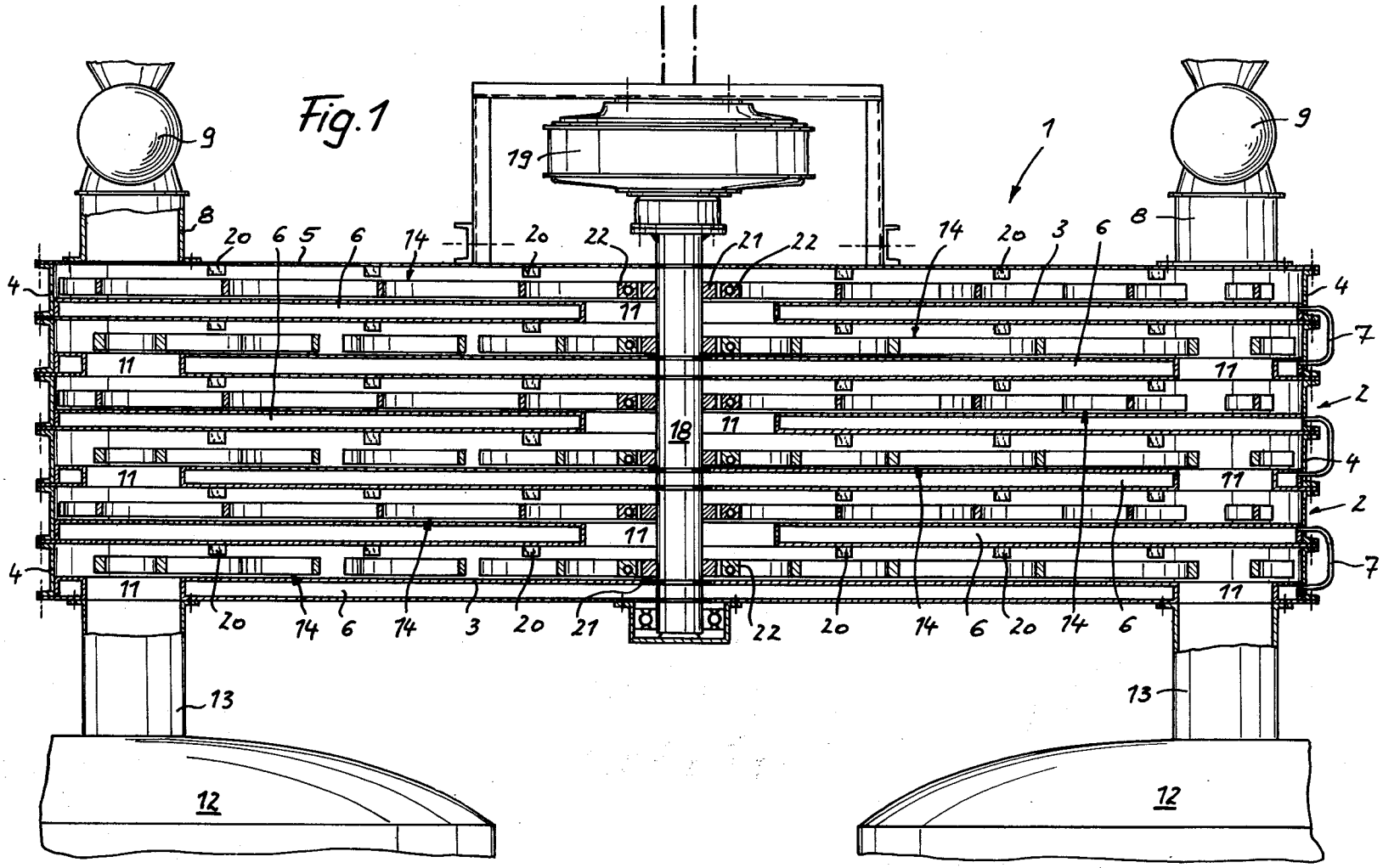

The present invention relates to a cooling device particularly for coal dust and comprises a housing provided with a motor-driven conveyor system to transport the coal dust or other material over coolable housing trays from one or more inlets to one or more outlets.

In order to obtain optimum efficiency in steam generators fired with coal dust, the coal dust is ground in mills before it is burned so as to obtain a particle size which is as uniform as possible.

As a result, however, the coal dust becomes heated by the grinding to such a high temperature as to make dangerous subsequent storage of the coal dust in bins.

The coal dust is therefore cooled during its transportation from the grinding mill to the storage bin(s). Heretofore, continuous conveyors constructed as drag chain conveyors had bottom cooling devices to cool the coal dust, water being usually employed as the cooling agent.

In order to obtain a sufficient reduction in temperature, the drag chain conveyors must, however, for this purpose be made materially wider and longer than required by their existing capacity and the distance from the mill to the bin, so that this form cooling device required relatively larger installation areas.

Furthermore, the losses due to radiation are rather substantial unless the cooling device of the drag chain conveyor is additionally insulated on its outer side.

The object of the present invention is to provide a cooling device of reduced required installation area and increased efficiency of cooling as compared to the drag chain conveyor type and to do so at only slight expense.

The object of the invention is achieved by means of the following features:

a. the provision of a housing of circular cross section;

b. a plurality of trays, arranged one above the other, provided in the housing;

c. all trays are equiped with cooling devices arranged on their bottom sides;

d. with each tray there is associated a conveyor wheel which moves over it, the conveyor wheels being driven by a common motor-rotatable shaft which is arranged vertically and coaxial to the housing;

e. in each tray there is provided at least one outlet, the outlets being arranged alternately in the center of the tray and close to the outer housing shell, respectively and f. the conveyor wheels are shaped and arranged to convey material from the inlet in the housing cover and/or from the outlet in the upper tray to the outlet(s) of the lowermost tray.

In this way there can be obtained much larger, coolable housing surfaces and longer conveyor paths than was heretofore customary with the same size installation area as previously. Furthermore, the cooling device is substantially more compact than has previously been the case and accordingly has a relatively small housing outer surface as compared with its volume.

In addition, by the present invention the coal dust is cooled both from the bottom and from the top during its transportation, except in the uppermost level of the housing, thus resulting in a considerable increase in efficiency.

A preferred embodiment of the invention which both simplifies manufacture and facilitates adaptation to the reduction in temperature required in each case is described hereinafter and includes a housing having a plurality of sections each of which is provided with a coolable tray.

Further features which both favor manufacture and reduce the cost thereof are set forth below in connection with the conveyor wheels and arms and their connecting struts.

For a quasi-lengthening of the conveyor paths of the coal dust and thus for a further increase in efficiency it is advantageous to construct and operate the conveyor wheels in the particular manner hereinafter described in connection with the spiral curvature of the conveyor-wheel arms and the structural features and details of the cooling device.

Figure 2:
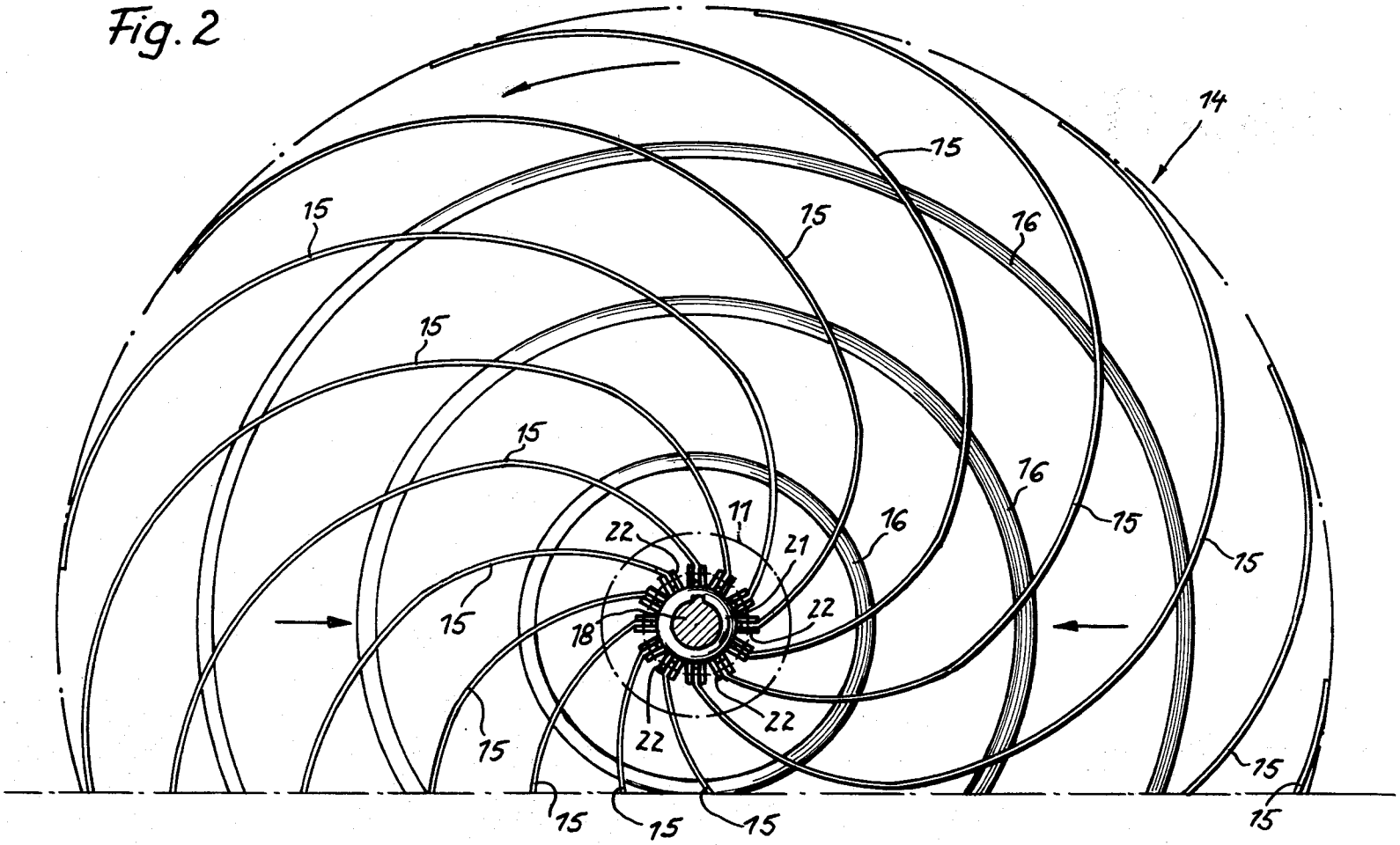
Figure 3:
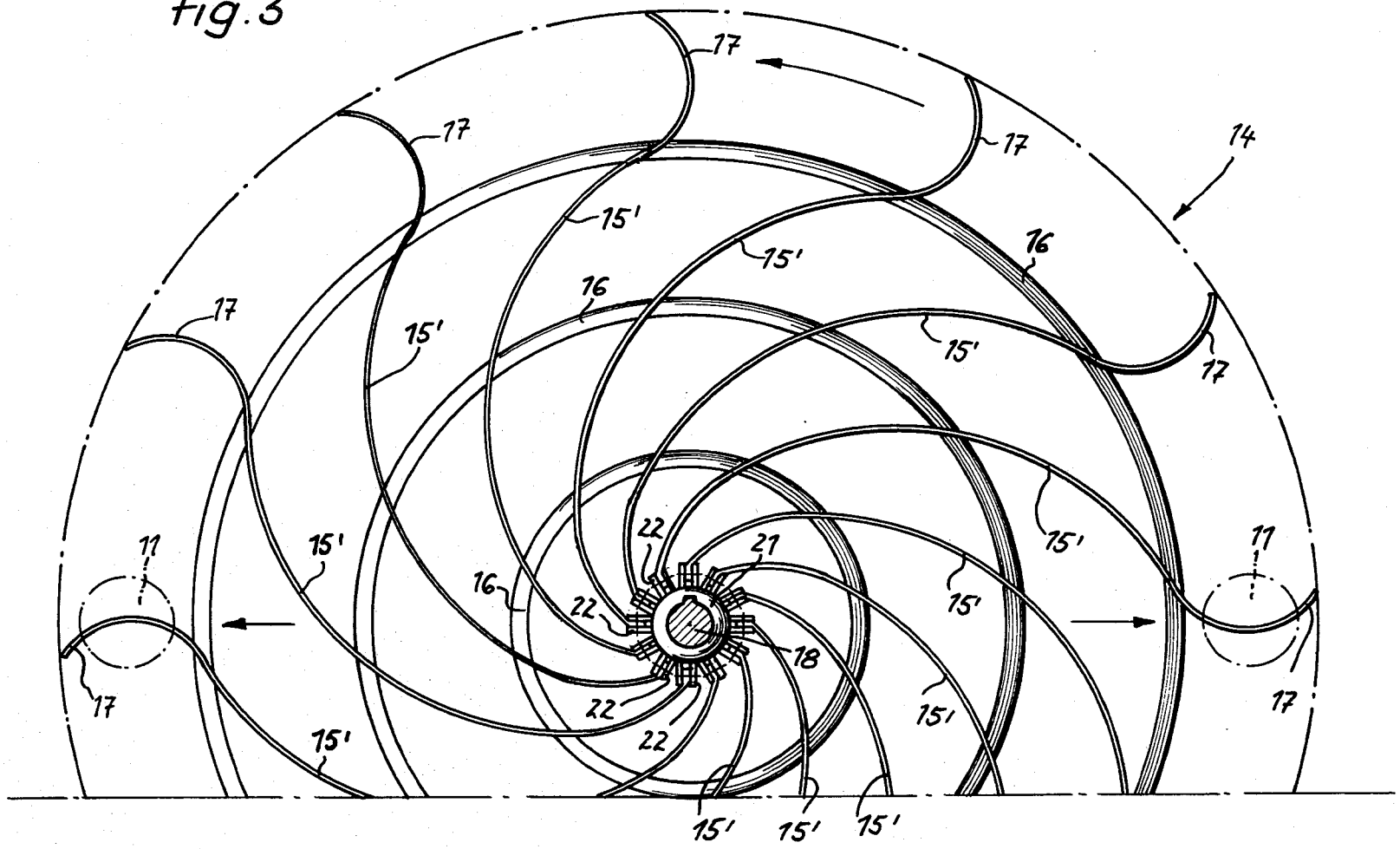

An illustrative embodiment of the invention is shown in the accompanying drawings wherein:

FIG. 1 shows a cooling device according to the invention partly in vertical section and partly in elevation; and FIGS. 2 and 3 show details of the conveyor arms thereof as seen from above.

According to the invention a circular housing 1 is assembled from a plurality of housing sections 2 vertically arranged one above another and connected or secured to each other. Each housing section has a tray member 3 and a ring-shaped shell 4. The uppermost housing section 2 is closed by a cover member 5.

On the bottom side of each tray member 3 a chamber 6 is provided which can be traversed by cooling agents and which chamber communicate with each other by pipelines 7. Two diametrically disposed conveyor-material inlets 8 are provided in the cover member 5, which inlets connect with the outlets of coal-dust mills 9 usually located above the cooling device. All tray members 3 are provided with conveyor-material outlets 11 arranged alternately in the center of the tray members 3 and close to the housing shell 4.

Furthermore, the cross-section of passage of each outlet 11 arranged centrally of its tray member is of the same size as the sum of the cross-sections of passage of two outlets 11 arranged per tray adjacent the housing shell 4.

Depending pipes 13 which discharge into bins 12 are connected to and communicate with the two outlets 11 of the lowermost housing section 2.

With each housing section 2 there is furthermore associated a rotatably supported conveyor wheel 14 whose arms 15 or 15' are stiffened by struts 16 and rest by means of the latter directly on the tray members 3.

The diameters of the conveyor wheels 14 correspond approximately to the inside dimension of the housing so that the conveyor wheels 14 pass over practically the entire surface of the tray members during their rotation.

The arms 15, 15' of the conveyor wheels 14 are curved spirally in such a manner that the upper conveyor wheel 14 conveys material from the housing shell 4 towards the center while the conveyor wheel arranged beneath the latter conveys material outwardly from the center, while the next succeeding conveyor wheel again conveys again from the outside towards the inside and so on until the coal dust (material) passes down into the depending pipes 13 from the lowermost conveyor wheel 14 which acts to convey material from the inside to the outside.

The conveyor arms 15' of the conveyor wheels 14 which convey from the inside to the outside, which conveyor arms are substantially curved spirally towards the rear as seen in the direction of rotation, terminate in regions 17 which are curved towards the front. All conveyor wheels 14 are fastened or suitably fixed or held on a common shaft 18 which passes axially through the housing 1 and which shaft can be placed in rotation by a hydraulic motor 19 which is held fast in position on the housing 1 above the latter.

Within each housing section 2 there are furthermore arranged baffles 20 which extend downward from the corresponding housing section 2 arranged above it and from the cover 5.

The hubs 21 of the converyor wheels 14 have a plurality of fork bearings 22 which are distributed uniformly on the circumference and in which the arms 15 or 15' can be replacably fastened by bolts.

The invention is intended to comprise the combination of features described and illustrated and variants thereof as well as the individual components and subassemblies, while the invention is particularly convern-ing with the conveying and cooling of coal dust it is not limited thereof as other fine or particulate material requiring similar treatment may behandled by the device.

I claim:

1. A cooling device for cooling coal dust or other fine particulate material both from its bottom and its top comprising a housing having a plurality of vertically arranged and secured housing sections of which the uppermost housing section is covered, a motor-driven conveyor device mounted in said housing to transport the coal dust or particulate material from one or more inlets to one or more outlets over the coolable bottom of the housing, the housing having a circular cross-section and a plurality of coolable tray members spaced one above another disposed in the housing, said tray members each being provided with cooling means arranged on their bottom sides and each tray member having associated therewith a conveyor wheel arranged to move over it, the wheels being connected to a common motor-rotatable shaft arranged vertically and coaxially with respect to the housing, each tray member having at least one outlet arranged alternately at the center of the tray member and adjacent an outer housing shell and the conveyor wheels being shaped to convey material from an inlet in the cover of the housing and/or from an outlet in the uppermost tray to an outlet of the lowermost tray, each tray member in each housing section being provided on its bottom side with a chamber traversable by cooling agents and which communicate with each other by pipelines.

2. A cooling device according to claim 1, wherein the conveyor wheels have arms resting on the housing tray associated with them, which arms are connected by struts extending in approximately circumferential direction and rest on the housing tray and wherein said arms are spirally curved forward and/or backward in their direction of rotation.

3. A cooling device according to claim 2, wherein baffles which tumble the material being conveyed are fixedly mounted on a frame above the conveyor wheels.

* * * * *